US005163863A

United States Patent [19]

Goldfarb et al.

[11] Patent Number: 5,163,863

[45] Date of Patent: Nov. 17, 1992

[54] ACTION TOY

[75] Inventors: Adolph E. Goldfarb, 1432 S. Eastwind Cir., Westlake Village, Calif. 91361; Martin I. Goldfarb, Santa Monica, Calif.

[73] Assignee: Adolph E. Goldfarb, Northridge, Calif.

[21] Appl. No.: 653,039

[22] Filed: Feb. 8, 1991

[51] Int. Cl.[5] ..... A63H 13/20

[52] U.S. Cl. ..... 446/236; 446/75; 446/304; 446/309; 472/8

[58] Field of Search ..... 446/308, 309, 304, 236, 446/241, 246, 75, 178; 273/243; 272/31 R

[56] References Cited

U.S. PATENT DOCUMENTS

| | | | |
|---|---|---|---|
| 1,348,921 | 8/1920 | Zion | 272/31 R |
| 2,789,395 | 4/1957 | Sprouse | 446/246 |
| 3,583,090 | 6/1971 | Fogarty | 446/75 |
| 3,799,544 | 3/1974 | Glass et al. | 272/31 R X |
| 3,984,105 | 10/1976 | Breslow | 273/243 X |
| 4,224,761 | 9/1980 | Wakimura | 446/236 X |
| 4,318,242 | 3/1982 | Lin | 446/178 |
| 4,928,955 | 5/1990 | Chuan | 272/31 R |

FOREIGN PATENT DOCUMENTS

| | | | |
|---|---|---|---|
| 1116992 | 5/1956 | France | 446/304 |

*Primary Examiner*—Mickey Yu

*Attorney, Agent, or Firm*—Ashen and Lippman

[57] ABSTRACT

An action toy for young children comprising a base that defines a pathway, and motor means on the base connected to a primary mobile object in the form of a personified animal or vehicle such as a toy shark for advancing the object forwardly along the pathway. Caming surfaces are spaced along the pathway and a matting caming surface is provided on the primary object. The caming surfaces are arranged and designed so that they engage and cause the primary object to raise upwardly at each pathway caming surface and then lower back down between pathway caming surfaces. This provides intermittent up and down movement of the primary object as it moves forwardly. Such movement could simulate the opening and closing of the jaws of the shark. Secondary objects such as small fish may also be provided for movement along the pathway; They may appear to be "swallowed" by the shark when it reaches one of them. In a travel toy form, the external components such as the shark and the fish may be detached and stored within the base.

12 Claims, 4 Drawing Sheets

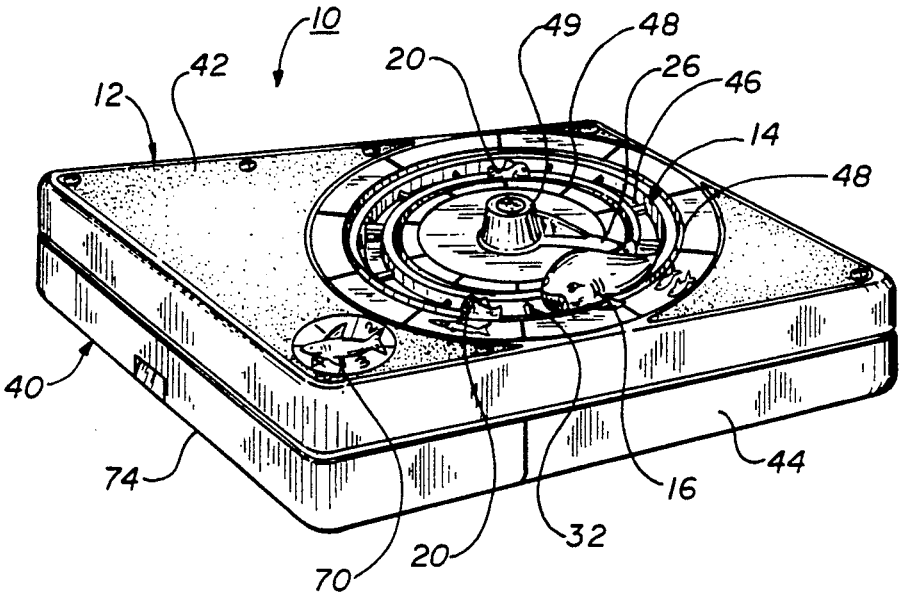
FIG. 1
FIG. 2
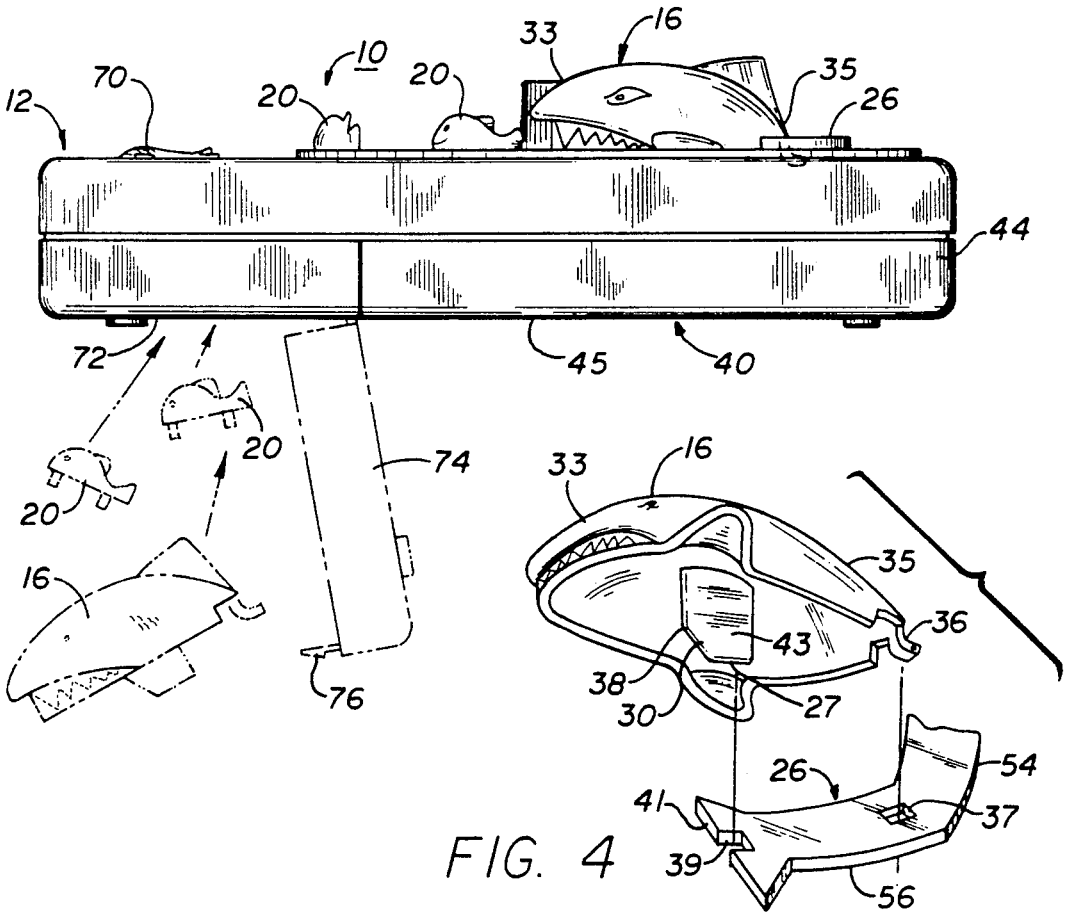
FIG. 4

ACTION TOY

BACKGROUND OF INVENTION

Applicant's prior U.S. Pat. No. 4,938,481 discloses an action toy device where a primary moving object in a form such as a toy shark or other character is self-powered for forward movement along a pathway. The shark includes a mechanism that periodically raises up the forward portion of the shark, which represents the jaws of the shark, as the shark moves forward from space to space along the pathway. The mechanism then causes the jaws to move downwardly toward the pathway. The shark pauses. Then the cycle repeats. When the shark catches up with a secondary object in a form such as a small toy fish on the pathway, the shark appears to "swallow" the fish.

The present invention also provides a primary mobile object which may represent a toy shark or the like, which chases secondary objects such as small toy fish along a pathway. The action of the shark is generally similar, i.e., forward and up and down; however, it is provided in a simpler and more economical construction. In general, a mechanism on the base moves the shark forwardly along a pathway. The rising and falling movement of the shark is provided by the engagement and disengagement of a cam surface on the shark with cam surfaces provided along the pathway. In one form, the drive mechanism rotates a rigid arm, with the shark mounted at the radially outer end of the arm. The shark thus moves around a circular pathway. The shark may be pivotally mounted on the driving mechanism so that its forward end will rise and fall, giving the illusion of its large jaws (with many teeth) opening and shutting. When the shark's jaws come down upon a fish, the fish appears to be swallowed. In a travel form of the toy, the shark, the small fish and other external parts of the toy such as the arm can be detached and stored within the base.

SUMMARY OF PREFERRED EMBODIMENT

The illustrated apparatus is in the form of an action toy (10) for younger children. Broadly, it includes a base (12) having a pathway (14), a primary mobile object (16) which may be in a form such as a shark, means (18) for advancing the shark along the pathway, and secondary objects (20) which may be in a form such as small fish for also advancing along the pathway. The fish (20) may be moved along the pathway (14) manually by the children-users ahead of the oncoming shark (16). The shark moves not only forwardly along the path, but at least a portion of it moves up and down as the shark advances. This simulates the appearance to the young child of the jaws of the shark opening and closing as it advances. When the moving shark overtakes a player's fish, the shark will rise up and come down on the smaller fish, thereby "swallowing" it, to the combined horror and excitement of the young children.

In the illustrated toy (10), a circular pathway (14) is defined on the top surface of the base (12). A spring wound motor (22) in the base rotates an upright drive shaft (24) to which a support arm (26) is detachably connected for common rotation. The shark (16) is detachably mounted on the arm (26) and is thereby advanced along the circular pathway. The shark is mounted so that at least a portion of it can also move upwardly and downwardly. A cam surface (30) on the shark successively engages cam surfaces (32) located along the pathway. The forward portion of the shark is raised upwardly at each pathway cam surface (32) as the shark moves forwardly along the pathway. The shark (16) has an internal cavity (34) in its forward end or jaws so that when the shark rises up and comes down on one of the fish, it will create the illusion to the young child user that the shark has "swallowed" the fish. More particularly, the shark may be pivotally mounted toward its rear end so that the engagement of the cam surface (30) on the shark with a cam surface (32) on the path, as the shark moves forwardly, causes the forward end ("jaws") of the shark to rise up and the jaws to open. The base may include a storage compartment for holding external elements of the toy, for use of the toy as a travel toy, for storage, or the like. The shark, the fish, and the arm supporting the shark may all be detachable for such storage.

IN THE DRAWINGS

FIG. 1 is a prospective view of the Action Toy which embodies a presently preferred form of the invention.

FIG. 2 is a side view of the Action Toy of FIG. 1, showing, in broken line, the lid of a storage compartment in opened position and elements of the toy that can be stored in the compartment.

FIG. 4 is an enlarged fragmentary view showing the connection between the toy shark and the support arm.

Figure 3:
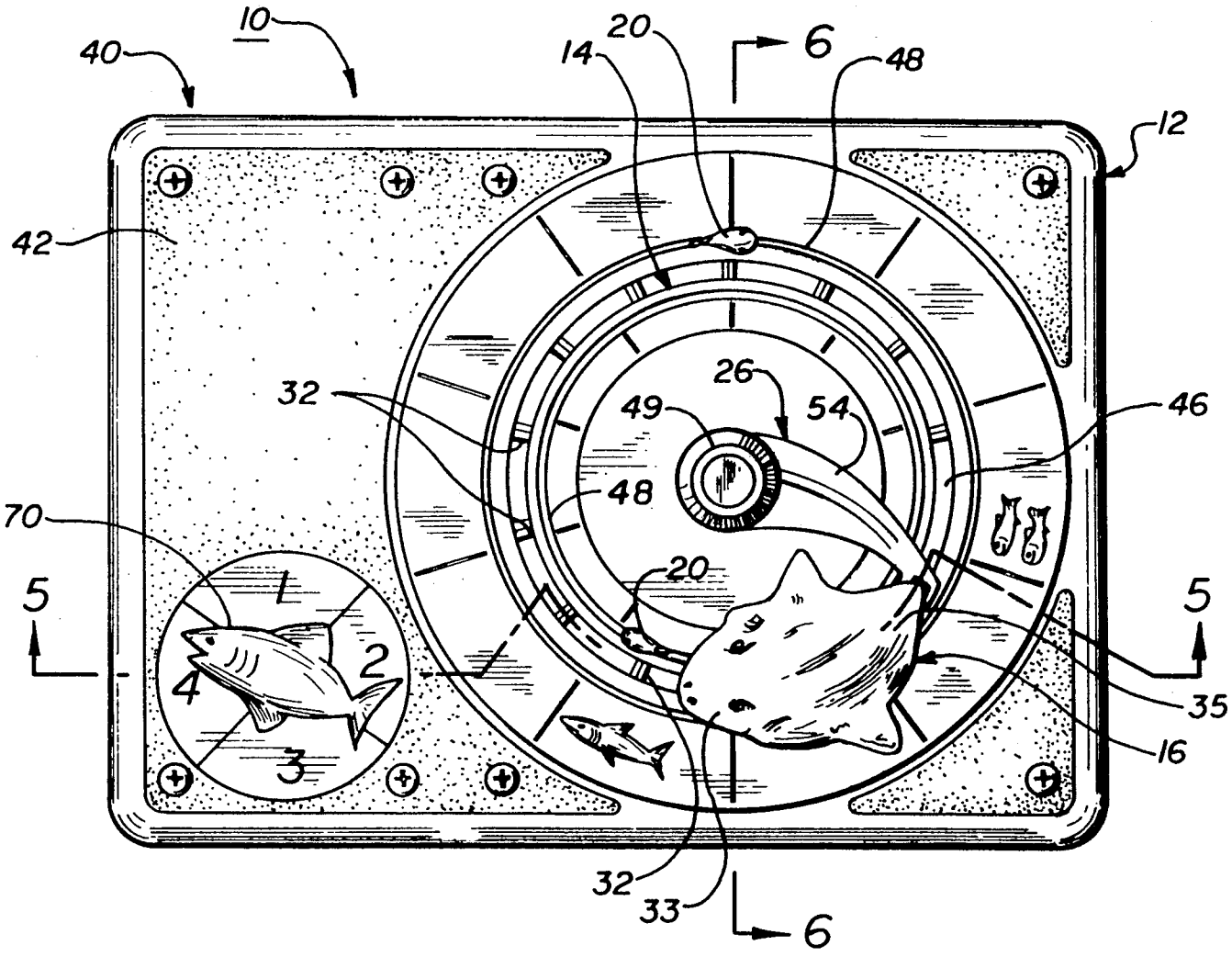
FIG. 3 is an enlarged top plan view of the Action Toy of FIGS. and 2.
Figure 5:
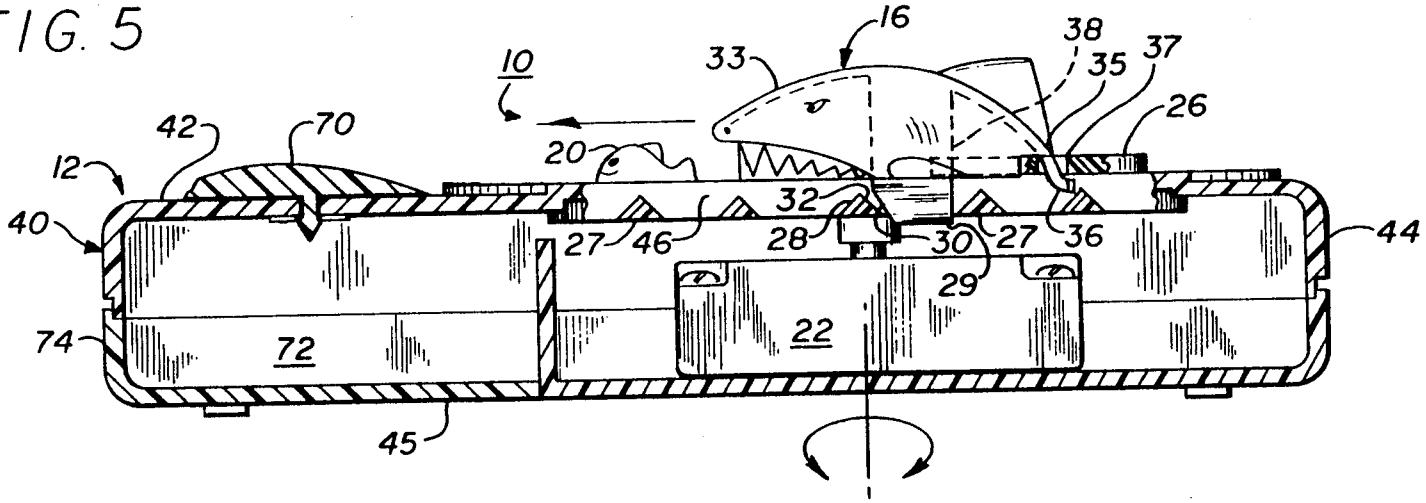
Figure 6:
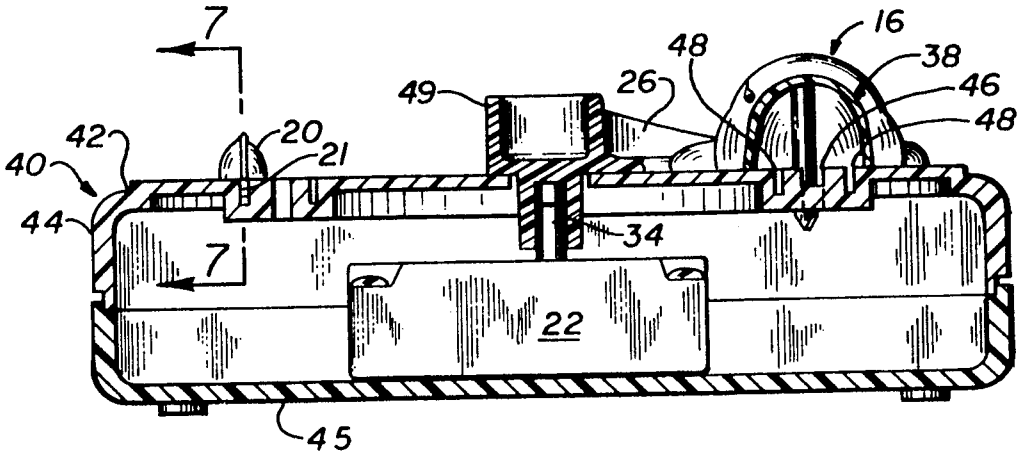

FIGS. 5 and 6 are sectional views taken along lines 5—5 and 6—6 respectively of FIG. 3.

Figure 7:
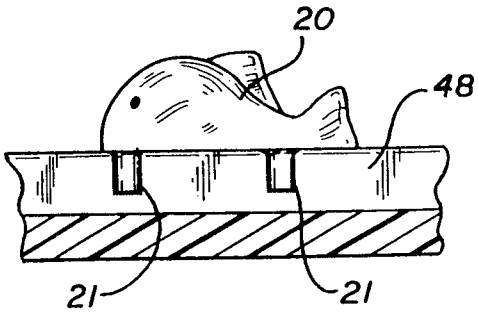

FIG. 7 is an enlarged side sectional view showing a toy fish.

Figure 8A:
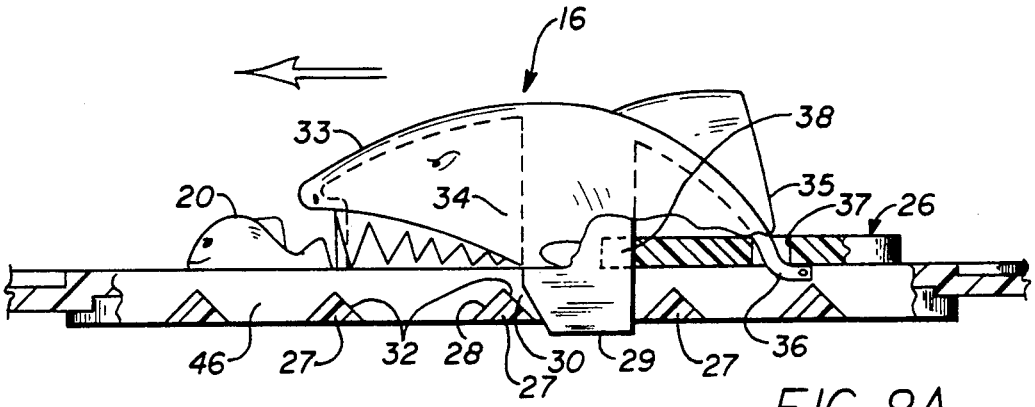
Figure 8B:
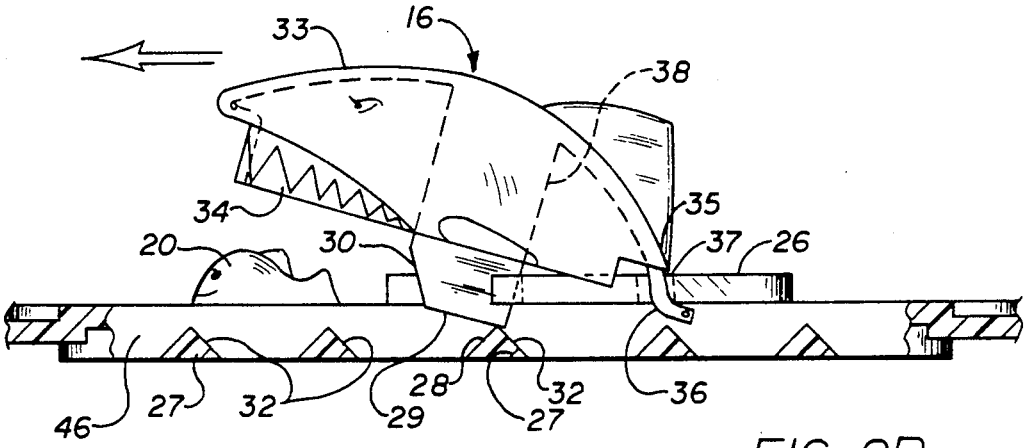
Figure 8C:
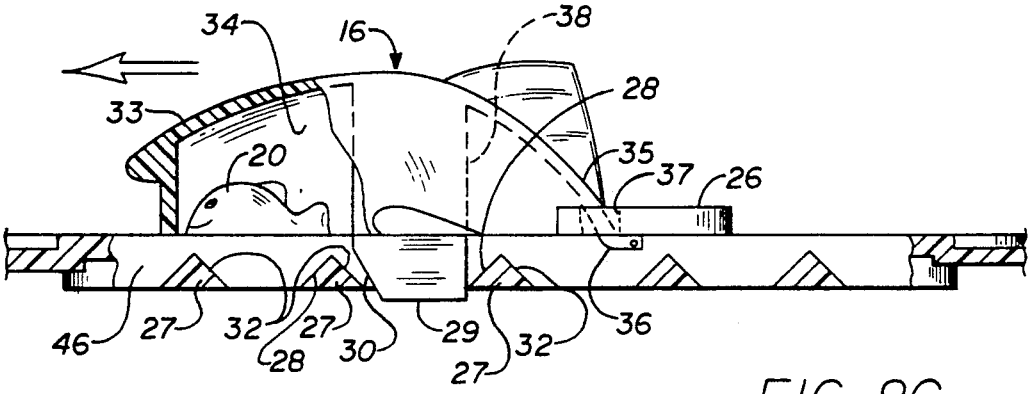

FIGS. 8A, 8B and 8C are enlarged transverse sectional fragmentary views showing the position of the toy shark in three successive positions along the pathway as it moves forwardly, then forwardly and upwardly, then forwardly and downwardly.

DETAILED DESCRIPTION OF DRAWINGS

The illustrated base (12) is in the form of a housing (40) having a generally horizontal upper wall (42), a depending side wall (44), and a bottom wall (45). The pathway (14) is defined in the upper wall (42). This circular pathway (14) shown in cross section in FIG. 6 has a central longitudinal slot or groove (46) and a pair of secondary longitudinal slots or grooves (48) positioned at either side of the central groove. The housing (40) is adapted to rest on a suitable supporting surface such as a table. The housing contains the standard wind-up motor (22) which has the upwardly extending output drive shaft (24) on which a winding knob (49) is detachably mounted for common rotation. The knob (49) can be removed from the shaft (24) by axial relative movement. The knob (49) extends upwardly through a central opening in the housing so it can be grasped and twisted by the child-user to wind up the motor. The shaft (24) and the knob (49) are aligned with the central axis of circular pathway (14). The knob (49) is fixed to the radially inner end of the rigid arm (26), so that rotation of the drive shaft (24) rotates the arm (26) around the central axis. The shark (16) is detachably and pivotally mounted on the radially outer portion (56) of the arm (26). More particularly, the illustrated arm (26) has a radially inner portion (54) that extends radially outwardly from the central axis, and a radially outer portion (56) that extends generally at a right angle to the inner portion. The illustrated shark (16) is mounted on and extends along the outer portion (56). The shark (16) and arm portion (56) are thus generally aligned with the pathway (14) so that as the shaft (24) rotates, the shark advances along the pathway.

The shark (16) may be made of molded plastic or other suitable material. Its front end (33) depicts a large fierce mouth with many teeth. Affixed in its rear end (35) there is a depending tab (36) which serves as the means for pivoting the shark upon the arm (26) The arm (26) has a mating cut-out or slot (37) for detachably receiving the depending tab (36), to thereby provide the pivotal or hinged connection between the shark and the arm. This allows the forward end (33) (the jaws) of the shark to rise upwardly and fall back downwardly. Intermediate the ends of the shark there is a downwardly extending plate element (38), generally aligned longitudinally of the shark and extending downwardly below the shark. A portion of this plate element (38) is received in a guiding slot (39) in the forward end (41) of the arm (26). The lower end (43) of the plate element (38) is formed with the forwardly facing, angled second cam surface (30) for intermittently engaging the rearwardly facing, angled cam surfaces (32) spaced along the pathway. The remainder of the lower end (43) extends straight back to form a horizontal cam surface portion (29) of the second cam surface (30).

The pathway (14) includes a longitudinally extending center slot or groove (46) in which the lower end (43) of the plate element (38) is received. At spaced intervals along this center slot (46), the pathway is provided with projections (27) that define the first cam surfaces (32). Each projection (27) has a generally upwardly pointed v-configuration which provides a rearwardly facing, angled cam surface (32) and a forwardly facing, angled cam surface (28). The projections (27) may be generally equally spaced or may be spaced at irregular intervals. In one form, if desired, the projections (27) might be adjustably positionable along the pathway so that the spacing between projections could be selectively changed by the user.

The small fish (20) may be made of molded plastic or other suitable material and each may include one or more depending pins (21) for being received in a longitudinal side slot (48) of the pathway. The pathway may be marked off in discrete spaces, and in play with the toy the child-user may manually advance his or her toy fish (20) a designated number spaces at his or her turn. The illustrated toy (10) includes a spinner in the form of a fish pointer (70) which can be used to determine how many spaces a fish is moved at a particular turn. In play with the apparatus, the object is to keep a player's fish ahead of and safe from the oncoming shark.

The cavity (34) within the front end (33) of the shark is sufficiently large add so positioned, relative to the size of the fish (20) and the location of the fish on the pathway, that when the shark comes down upon a position where a fish is located, the fish will be received within that internal cavity and the illusion will be given that the shark has "swallowed" the fish in its massive jaws.

FIGS. 8A, 8B and 8C illustrate the progressive movement of the shark (16) relative to the pathway (14) and to a small fish (20). Initially, as the shark moves forwardly along the pathway, the plate element (38) is received within the central slot (46) of the pathway and the shark rests upon the upper surface of the pathway. When the forward facing, angled cam surface (30) of the shark engages a rearward facing, angled cam surface (32) along the pathway, the forward end (33) of the shark is caused to pivot upwardly in connection with its continued forward movement This elevates the front end (33) of the shark above the toy fish in its path. As the shark continues to move forwardly, the flat cam surface (29) continues to engage the tip of the projection (27) to maintain the front end (33) of the shark elevated enough to pass over a fish (20) in its path (FIG. 8B). When the flat cam surface (29) on the shark passes the tip of the projection (27) and continues forward, the plate element (38) slides down the forwardly facing, angled cam surface (28) of the pathway projection. This allows the front end (33) of the shark to be lowered back down to the level of the pathway (FIG. 8C). In the process, the fish, which is disposed beneath the cavity (34) of the shark is enclosed, and thus "swallowed", by the shark.

In the play of game by one or more young players, the spring wind up motor (22) is initially wound by simply turning the knob (49) to rotate the drive shaft (24) on the motor. If desired, means such as a mechanical switch (19) may be provided for selectively starting and stopping the action of the motor. The player/players then move their fish along the outer channels (48) of the pathway in accordance with the results on the pointer (70), trying to keep ahead of the oncoming shark. The play of the particular game may end when the shark swallows one or more of the fish. In addition, if desired, more than one fish may he positioned along a particular outer channel (48) at the same time, to accommodate more players or longer play of each game.

The illustrated housing (40) is provided with a compartment (72) for storing components of the game. The compartment (72) has an openable lid (74) with a latch (76) to releasibly retain the lid in the closed position. Such a compartment is particularly desirable when the game is in the form of a travel toy. This compartment can contain not only the small fish (20), but the shark (16) which is readily detached, and the arm (26) and knob (49) which also may be readily detached. It will be noted that the end of the drive shaft (24) is recessed within the housing (40) for such travel or storage purposes.

In an alternate form, the motor may be provided by an electric motor and a suitable reduction gear-train which reduces the speed of rotation of the output shaft so that the shark will travel at a sufficiently slow rate along the pathway. Such an electric motor may be provided with power by means of batteries which may be removably held in a suitable compartment within the housing. This arrangement will allow the toy to be used as a portable or travel item. Further, such an electric motor form of the apparatus can alternately, or in addition, be provided with a cord for plugging into a suitable electrical outlet. When there is a cord in addition to batteries, the cord can be used when convenient without putting a drain on the batteries, while still having the batteries available for travel purposes or at locations away from an electrical outlet.

The primary mobile object may take various other forms than a shark and the secondary objects may take other forms than small fish. For example, the primary object may be a cat and the secondary objects could be mice. Similarly, the primary object could be a personified bulldozer and the secondary object might be small cars or trucks.

Various other modifications and changes may be made to the illustrated structure without departing from the spirit and scope of the present invention as set forth in the following claims.

We claim:

1. An action toy for younger children comprising:

a base;

means on the base defining a pathway;

a primary mobile object adapted for movement along the pathway and for movement of at least the forward end of the primary object up and down relative to the pathway incident to the forward movement;

means on the base operatively connected to the primary object for moving the primary object forwardly along the pathway;

first caming means on the pathway defining a plurality of first cam surfaces spaced apart along the pathway;

second caming means on the primary object defining a second surface for successive engaging the first cam surfaces as the primary object moves forwardly along the pathway;

said first and second cam surfaces being configured and positioned so that, as said primary object moves forwardly, said forward end of the primary object is raised upwardly from the pathway each time the second cam surface reaches and engages one of said first cam surfaces, and so that the primary object moves back downwardly each time the second cam surface moves past a first cam surface, said forward end of the primary object having an interior cavity;

and at least one secondary object provided on the pathway and proportioned to fit into the cavity at the forward end of the primary object.

2. The toy of claim 1 wherein the primary mobile object is pivotally mounted so that at least a portion of said object is movable away from and back toward the pathway.

3. The toy of claim 2 wherein the front end of the primary mobile object is upwardly and downwardly pivotally movable.

4. The toy of claim 1 wherein the pathway is provided with a slot for the primary mobile object and a slot for the secondary object, said slots extending lengthwise of the pathway.

5. The toy of claim 1 wherein the primary mobile object represents a living character, and represents a mouth for the character at the front of the object.

6. The toy of claim 4 wherein there are a plurality of said secondary objects and they are detachably positionable in the associated pathway slot.

7. The toy of claim 1 wherein said moving means includes motor means and a rigid member that supports the primary mobile object, the rigid member being movable by the motor means to cause the primary mobile object to move along the pathway.

8. The toy of claim 7 wherein the base comprises a housing- having a top wall and side walls that generally enclose said motor means.

9. The toy of claim 7 wherein the pathway is generally circular and the rigid member is in the form of a support arm that extends from the center of the circle defined by the pathway radially outwardly toward the pathway.

10. An action toy for younger children comprising:

a base;

means on the base defining a pathway;

a primary mobile object adapted for movement along the pathway and for movement of at least a portion of the primary object up and down relative to the pathway incident to the forward movement;

means on the base operatively connected to the primary object for moving the primary object forwardly along the pathway;

first caming means on the pathway defining a plurality of first cam surfaces spaced apart along the pathway;

second caming means on the primary object defining a second surface for successive engaging the first cam surfaces as the primary object moves forwardly along the pathway;

said first and second cam surfaces being configured and positioned so that, as said primary object moves forwardly, said at least a portion of the primary object is raised upwardly from the pathway each time the second cam surface reaches and engages one of said first cam surfaces, and so that the primary object moves back downwardly each time the second cam surface moves past a first cam surface, said moving means including motor means and a rigid member that supports the primary mobile object, the rigid member being movable by the motor means to cause the primary mobile object to move along the pathway;

the pathway being generally circular and the rigid member being in the form of a support arm that extends from the center of the circle defined by the pathway radially outwardly toward the pathway;

said motor means having an output shaft and said support arm being connected to said output shaft for common rotation, said support arm and said output shaft being configured for ready detachment from each other by the child-user without the use of tools;

said base having an upper surface, said upper surface having a generally central opening therethrough, the output shaft of the motor being generally upright and aligned with said central opening, the upper end of said shaft being substantially no higher than the level of the upper surface, said support arm being detachably connected to the shaft through said central opening whereby, when the arm is detached from the shaft, the shaft does not substantially protrude above the level of the upper surface.

11. The toy of claim 10 wherein said primary object is detachably mounted on said support arm for common rotation with said arm.

12. The toy of claim 11 wherein the arm has a recess and the primary object has a mating projection that is detachably received in the recess, this connection between the recess and the projection being constructed and arranged to permit upward and downward pivoting of portions of the primary object as well as forward movement of the primary object incident to forward movement of the arm.

* * * * *